US010998674B1

(12) United States Patent
Moll et al.

(10) Patent No.: US 10,998,674 B1
(45) Date of Patent: May 4, 2021

(54) ELECTRICAL CONNECTOR WITH BIASED LATCH

(71) Applicant: TE Connectivity Services GmbH, Schaffhausen (CH)

(72) Inventors: Hurley Chester Moll, Hershey, PA (US); Eric John Torrey, Bloomfield Hills, MI (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/686,817

(22) Filed: Nov. 18, 2019

(51) Int. Cl.
*H01R 13/627* (2006.01)
*H01R 43/26* (2006.01)
*H01R 13/629* (2006.01)

(52) U.S. Cl.
CPC ..... *H01R 13/6272* (2013.01); *H01R 43/26* (2013.01); *H01R 13/627* (2013.01); *H01R 13/629* (2013.01); *H01R 13/6271* (2013.01)

(58) Field of Classification Search
CPC ..... H01R 13/6272; H01R 43/26; H01R 13/6273; H01R 13/627; H01R 13/6271; H01R 13/629; H01R 13/62933; H01R 13/62955
See application file for complete search history.

(56) References Cited

U.S. PATENT DOCUMENTS

| | | | | |
|---|---|---|---|---|
| 3,706,067 | A * | 12/1972 | Hanson | H01R 13/6272 439/155 |
| 6,341,973 | B1 * | 1/2002 | Endo | H01R 13/6272 439/350 |
| 6,773,272 | B2 | 8/2004 | Koehler et al. | |
| 6,786,742 | B2 * | 9/2004 | Matsuoka | H01R 13/6272 439/95 |
| 7,080,990 | B1 | 7/2006 | Juntwait et al. | |
| 10,455,712 | B1 | 10/2019 | Malecke et al. | |

* cited by examiner

*Primary Examiner* — Renee S Luebke
*Assistant Examiner* — Paul D Baillargeon

(57) ABSTRACT

An electrical connector with biased latch and method. The electrical connector has a housing and a latch which extends from the housing. The latch has a latching region and a biasing region. The latching region has a latching projection with a reference surface. The biasing region has a biasing member. The cooperation of the biasing member with a mating electrical connector and the reference surface with the mating electrical connector prevents the unwanted movement of the electrical connector relative to the mating electrical connector.

19 Claims, 6 Drawing Sheets

ELECTRICAL CONNECTOR WITH BIASED LATCH

FIELD OF THE INVENTION

The present invention is directed to an electrical connector with a latch with a biasing member. In particular, the invention is directed to a latch with a biasing member which secures the latch and connector in position to minimize the effect of manufacturing tolerances.

BACKGROUND OF THE INVENTION

When assembling an electrical connector to a mating electrical connector or panel, one or more resilient beams or latches are used to secure the parts together. As the electrical connectors are mated, the resilient beams deflect and are moved past mating surfaces of mating beams. In order to facilitate the movement of the flexible beams, the beams must be permitted to move past or overtravel the mating surfaces to permit the beams to move back toward their unstressed. Consequently, when the connectors are mated, the electrical connector has some movement or play relative to the mating connector. While in many circumstances, the movement between the connectors is not harmful, in other circumstances, such as is situations where there are very tight tolerances, the movement of the connectors is not acceptable.

It would be, therefore, beneficial to provide electrical connector with a beam or latch with a biasing member, wherein the biasing member cooperates with the mating connector to bias the beam or latch against a reference surface of the mating connector to accurately and precisely position the connector relative to the mating connector.

SUMMARY OF THE INVENTION

An embodiment is directed to an electrical connector having a housing and a latch. The latch extends from the housing and has a latching end and an oppositely facing biasing end. The latching end has a reference surface. The biasing end has a biasing member. The biasing member cooperates with a mating connector to bias the reference surface of the latching projection against a mating connector reference surface of the mating electrical connector. The cooperation of the biasing member with the mating electrical connector and the reference surface with the mating reference surface prevents the unwanted movement of the electrical connector relative to the mating electrical connector.

An embodiment is directed to an electrical connector having a housing and a resilient latch which extends from the housing. The resilient latch has a latching region and a biasing region. The latching region has a latching projection with a locking surface. The biasing region has a biasing member. The cooperation of the biasing member with a mating electrical connector and the locking surface with the mating electrical connector prevents the unwanted movement of the electrical connector relative to the mating electrical connector.

An embodiment is directed to a method of inserting an electrical connector into a mating electrical connector. The method comprising: inserting a latching area of a latch of the connector into a mating latching area of the mating connector; engaging a portion of the mating connector with a biasing member of the latch as the latching area is moved proximate the mating latching area to resiliently deform a biasing member of the latch; and moving the biasing member toward an unstressed position, causing a locking surface of the latch to engage a mating locking surface of the mating connector. The cooperation of the biasing member with the mating electrical connector and the locking surface with the mating locking surface prevents the unwanted movement of the electrical connector relative to the mating electrical connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
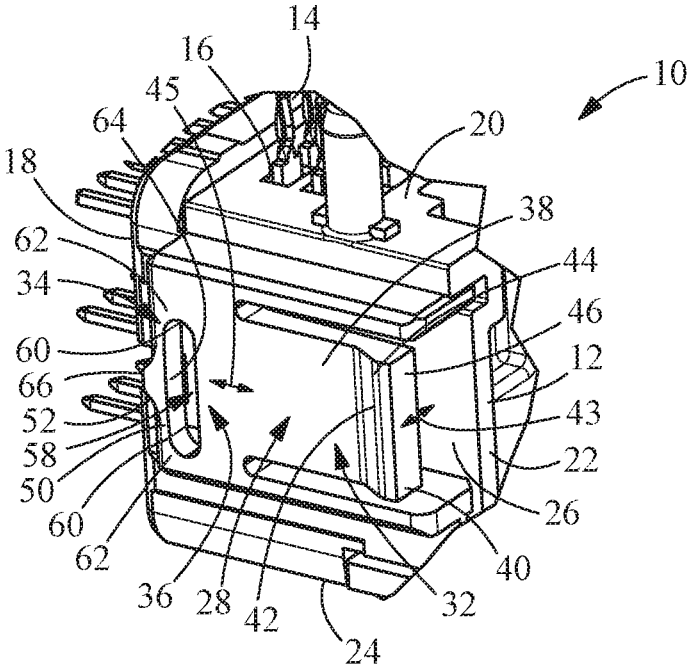
FIG. 1 is a top perspective view of an illustrative electrical connector of the present invention, showing a resilient latch and a biasing member.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an electrical connector 10 has a housing 12 with terminals 14 positioned in terminal receiving cavities 16. The particular configuration and the number of the terminals 14 and terminal receiving cavities 16 may vary without departing from the scope of the invention. The housing 12 has a first wall or mating face 18, a circuit board receiving face 20, a second or back wall 22, a bottom wall 24 and side walls 26.

Figure 6:
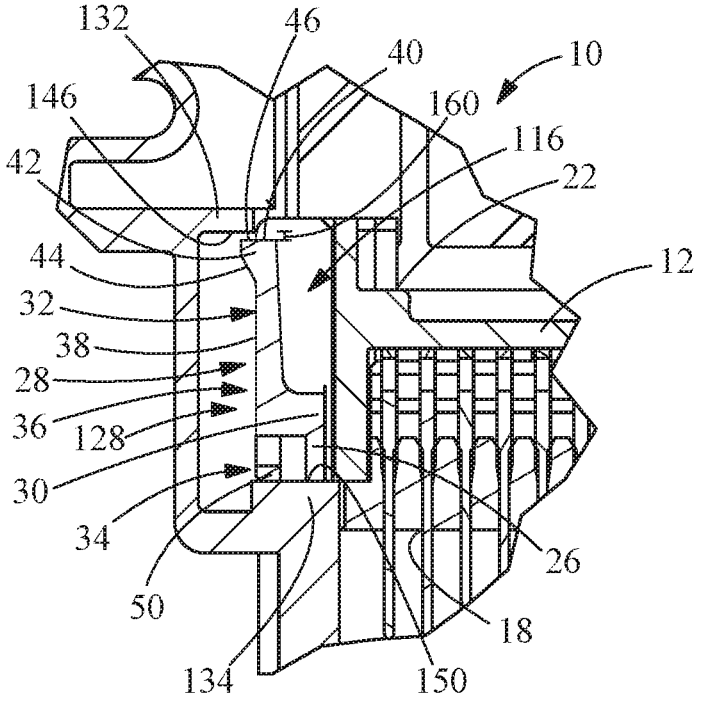
FIG. 6 is a cross-sectional view of taken along line 6-6 of FIG. 3.
Figure 8:
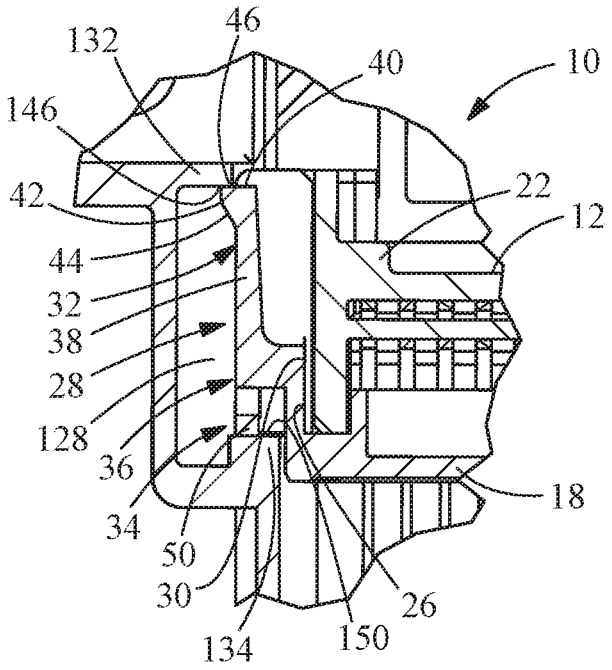
FIG. 8 is a cross-sectional view of taken along line 8-8 of FIG. 4.

In the illustrative embodiment shown in FIG. 1, a latch 28 extends from proximate the first wall 18 of the housing 12 to proximate the second wall 22. As shown in FIGS. 6 and 8, the latch 28 has attachment sections 30 which attach the latch 28 to the side wall 26 of the housing 12. The latch 28 has a latching region or end 32 and an oppositely facing biasing region or end 34. A transition region or section 36 extends between the latching region or end 32 and the biasing region or end 34.

The latching region or end 32 has a resilient latching arm 38 which extends from the transition region or section 36. The latching arm 38 has a free end 40 with a latching projection 42 provided proximate thereto. The latching projection 42 has a lead-in surface 44 and a locking or reference surface 46. Although the locking or reference surface 46 is positioned on the latching projection 42, the locking or reference surface 46 may be provided at other locations on the latch 28. The latch projection 42 is resiliently deformable in a direction of arrow 43 shown in FIG. 1.

Figure 5:
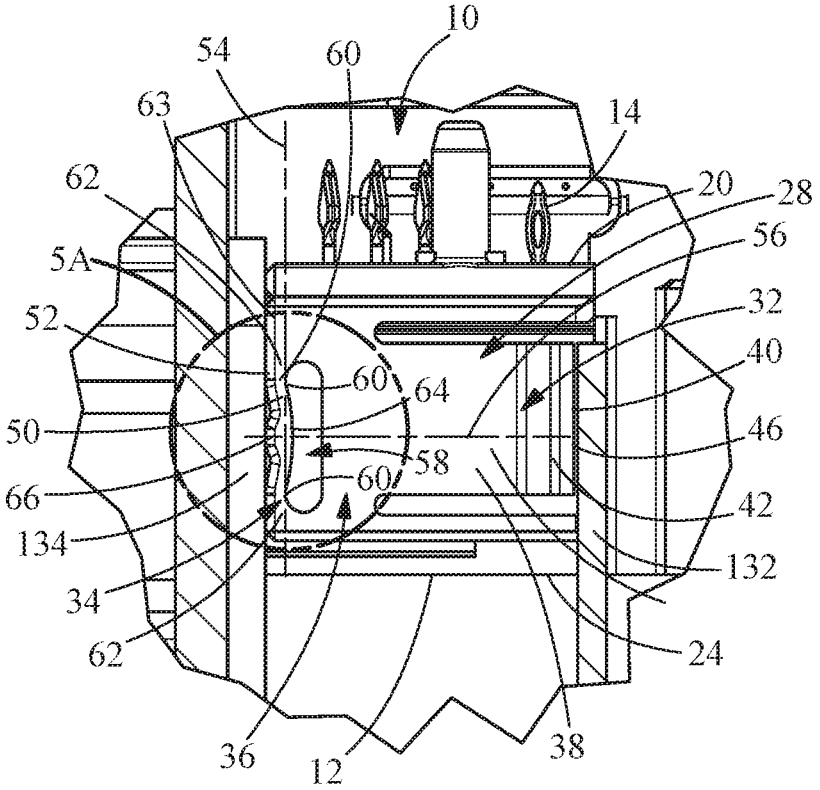
FIG. 5 is a cross-sectional view of taken along line 5-5 of FIG. 3.
Figure 7:
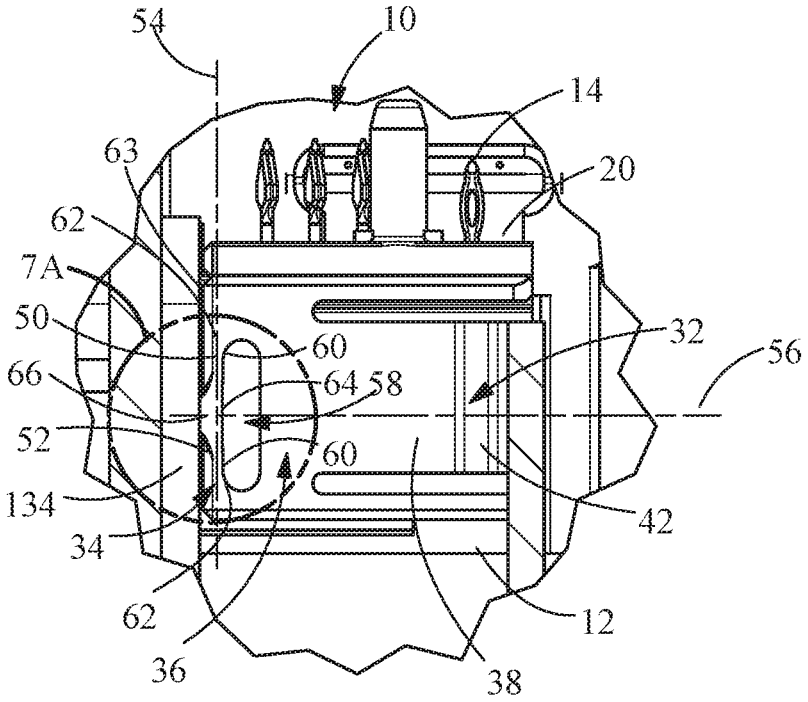
FIG. 7 is a cross-sectional view of taken along line 7-7 of FIG. 4.

The biasing region or end 34 has a biasing member or resilient arm 50. The biasing member or resilient arm 50 is provided proximate a first end surface 52 provided at the biasing region or end 34 of the latch 28. The biasing member or resilient arm 50 is resiliently deformable in a direction of arrow 45 shown in FIG. 1. As shown in FIGS. 5 and 7, a longitudinal axis 54 of the biasing member or resilient arm 50 extends in a direction which is essentially perpendicular to a longitudinal axis 56 of the latch 28. An elongate opening 58 is provided proximate the resilient arm 50. The resilient arm 50 is positioned between the elongate opening 58 and the first end surface 52 of the latch 28. The elongate opening 58 is provided between the resilient arm 50 and the transition region or section 36 of the latch 28.

The resilient arm 50 is fixed to the transition region or section 36 at either end 60 by mounting sections 62. With the resilient arm 50 fixed at either end 60, the center portion 64 of the resilient arm 50 is able to resiliently deform into the elongated opening 58, allowing the resilient arm 50 to be moved between a stressed and an unstressed position, as will be more fully described A biasing projection 66 extends from the center portion 64 of the resilient arm 50. The biasing projection 66 extends from the first end surface 52 in a direction away from the latching region or end 32. One biasing projection 66 is positioned at the center of the resilient arm 50, however, other numbers, configurations and positioning of the biasing projection 66 can be used.

Figure 2:
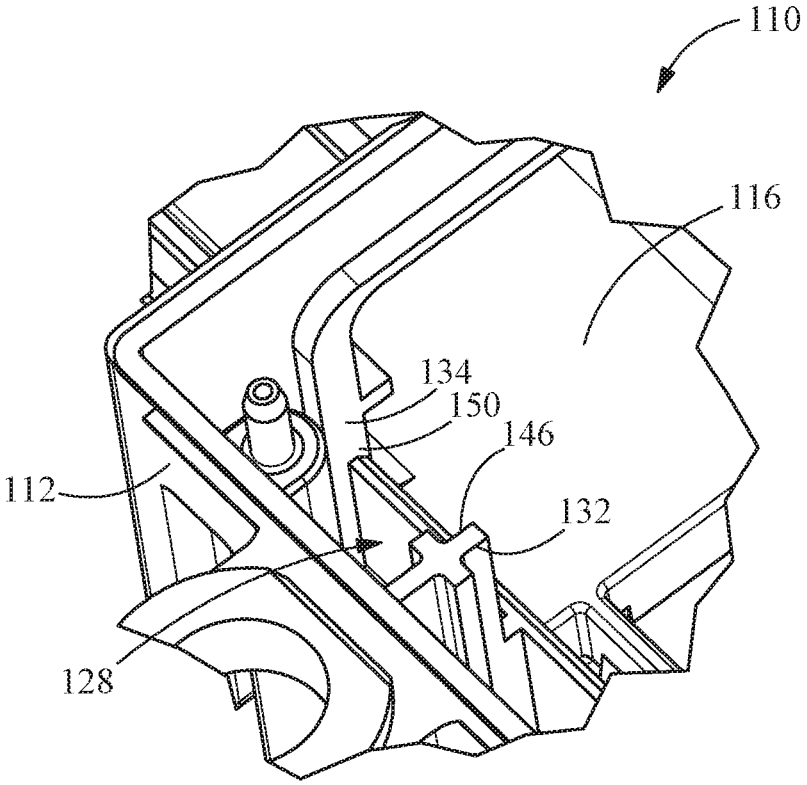
FIG. 2 is a top perspective view of an illustrative mating electrical connector, showing the mating area in which the resilient latch is inserted.
Figure 3:
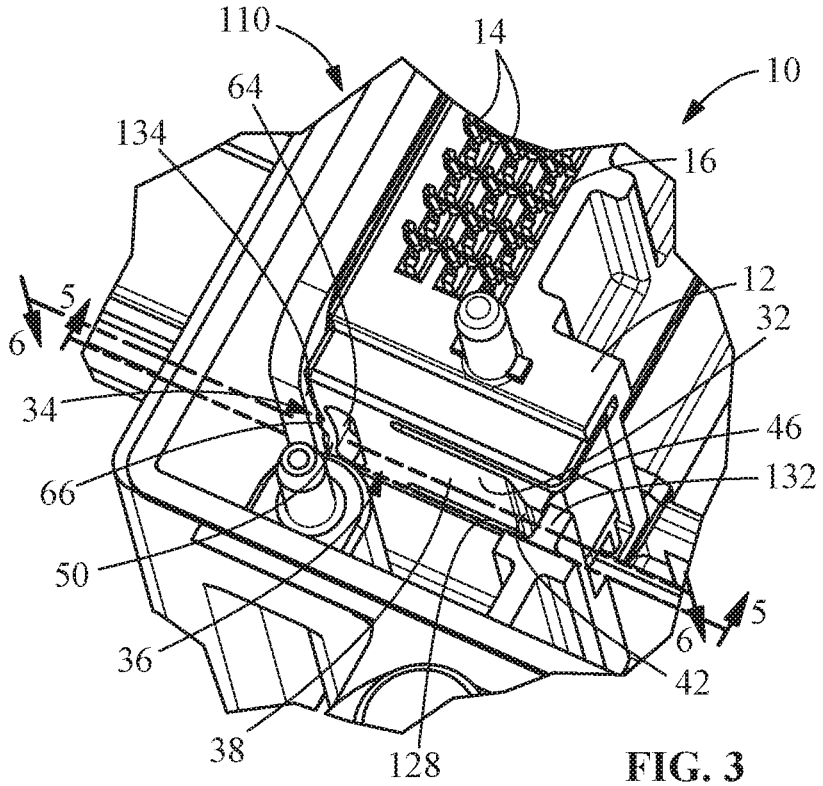
FIG. 3 is a top perspective view of the electrical connector of FIG. 1 and the mating electrical connector of FIG. 2 as the electrical connector is mated with the mating connector.
Figure 4:
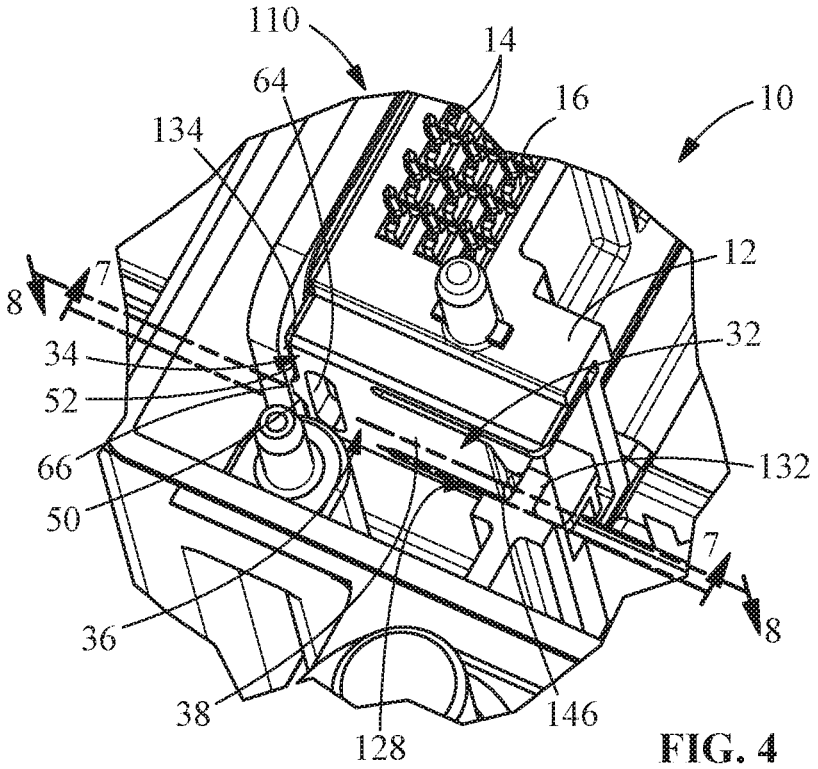
FIG. 4 is a top perspective view of the electrical connector of FIG. 1 fully mated with the mating electrical connector of FIG. 2.

As shown in FIG. 2, a mating electrical connector 110 has a housing 112 with a connector receiving recess 116. A latch receiving recess 128 extends from the connector receiving recess 116. The latch receiving recess 128 has a latching region or end 132 and an oppositely facing biasing region or end 134. In various embodiments, more than one latch receiving recess 128 may extend from the connector receiving recess 116.

As shown in FIGS. 2, 6 and 8, the latching region or end 132 has a mating locking or reference surface 146. The biasing region or end 134 has a biasing surface 150. The mating locking or reference surface 146 is configured to face the biasing surface 150. The mating locking or reference surface 146 and the biasing surface 150 are two walls which define the latch receiving recess 128. As shown in FIG. 6, the biasing surface 150 extends further into the connector receiving recess 116 than the mating locking or reference surface 146.

The electrical connector 10 is inserted into the mating electrical connector 110. During insertion, the latch 28 is moved into the latch receiving recess 128. As this occurs, the latching arm 38 engages the latching end 132 of the latch receiving recess 128. Continued insertion causes the lead-in surface 44 of the latching projection 42 of the latching arm 38 to engage the latching end 132 of the latch receiving recess 128, causing the latching projection 42 and the latching arm 38 to resiliently deform toward the first wall 22 of the housing 12 of the connector 10. With continued insertion, the latching projection 42 is moved past the latching end 132, to the position shown in FIGS. 5 and 6, allowing the latching arm 38 to return to its unstressed position. In this position, the locking or reference surface 46 is positioned proximate to and is facing the mating locking or reference surface 146.

In order to allow the latching arm 38 to return to its unstressed position, the latching projection 42 must be moved a sufficient distance past the surface 146 of the latching end 132 to allow for the unrestricted movement of the latching arm 38. In so doing, a gap 160, as shown in FIG. 6, is created between the locking or reference surface 46 and the mating locking or reference surface 146. This gap 160 is not desired, as it allows movement between the connector 10 and the connector mating connector 110.

As the insertion of the electrical connector 10 into the mating electrical connector 110 occurs, the biasing projection 66 of the resilient arm 50 of the biasing portion or end 34 of the latch 28 engages the biasing surface 150 of the latch receiving recess 128. This occurs at the same time, or approximately at the same time as the latching projection 42 is engaged with the surface 146 of the latching end 132.

Figure 5A:
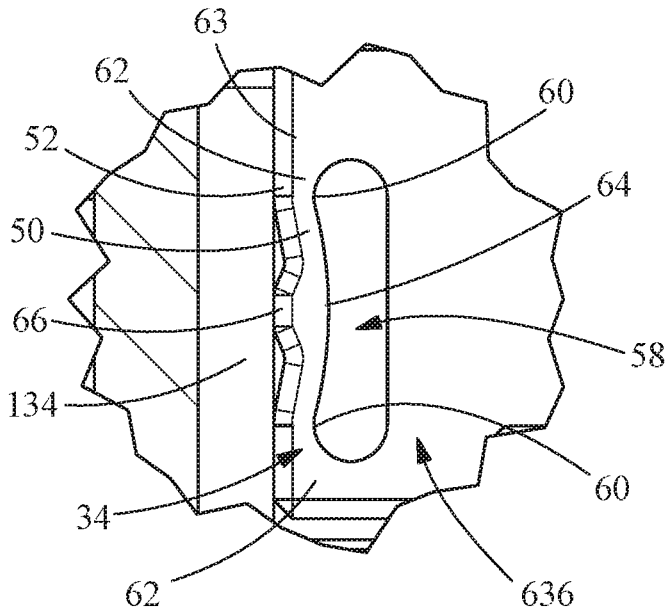
FIG. 5A is an enlarged section of a portion of FIG. 5.

With continued insertion, as shown in FIG. 5, the engagement of the biasing surface 150 with the biasing projection 66 of the resilient arm 50 causes the resilient arm 50 to resilient deform, as shown in FIGS. 5 and 5A.

Continued insertion of the electrical connector 10 into the mating electrical connector 110 allows the latching projection 42 to be moved past the surface 146 of the latching end 132. As this occurs, the latching arm 38 returns to its unstressed position, as described above. Continued insertion is prevented as a bottom surface 63 of the latch 28 engaged the biasing surface 150, prevents the further movement of the biasing projection 66 and the resilient arm 50 in the direction of insertion. Consequently, as the biasing projection 66 of the resilient arm 50 are prevented from further advancement, the resilient arm 50 is resiliently deformed into the opening 58, causing the resilient arm 50 to be moved to a stressed position.

As shown in FIGS. 5 and 5A, when resiliently deformed, the mounting sections 62 of the resilient arm 50 remain fixed while the center portion 64 of the resilient arm 50 is resiliently deformed into the elongated opening 58, placing the resilient arm 50 in a resiliently deformed or stressed position. This allows the resilient arm 50 to act as a spring member.

Figure 7A:
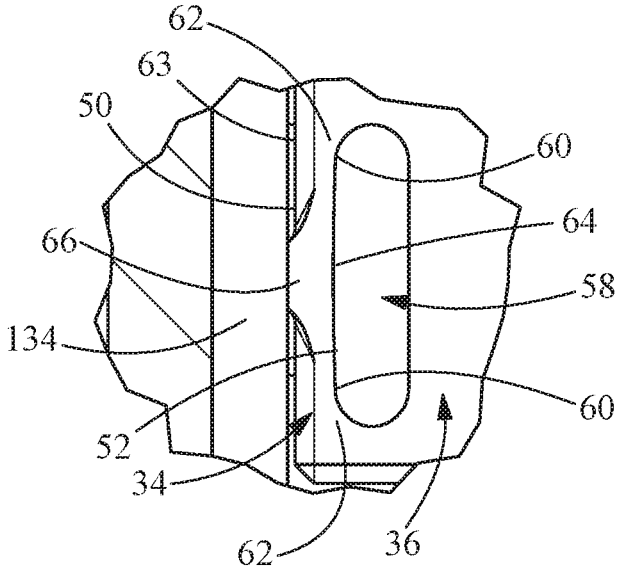
FIG. 7A is an enlarged section of a portion of FIG. 7.

The insertion force exerted on the connector 10 and latch 28 is then removed. With the insertion force removed, the resilient arm 50 attempts to return to the unstressed position and exert a force on the biasing surface 150. As the biasing surface 150 is fixed, the movement of the resilient arm 50 back toward its unstressed position causes the latch 28 and the connector 10 to be moved back toward the mating locking or reference surface 146 of the mating connector 110. This movement continues until the locking or reference surface 46 engages the mating locking or reference surface 146, thereby eliminating the gap between the locking or reference surface 46 and the mating locking or reference surface 146. As shown in FIGS. 7, 7A and 8, with the locking or reference surface 46 in engagement with the mating locking or reference surface 146 and the biasing projection 66 of the resilient arm 50 in engagement with the biasing surface 150, the resilient arm 50 remains in a slightly biased or stressed position, causing the locking or reference surface 46 to remain in engagement with the mating locking or reference surface 146, thereby ensuring that the latch 28 is accurately and precisely retained in position in the latch receiving cavity 128, and consequently, the connector 10 is accurately and precisely retained in the mating connector 110.

As described above, the method of inserting an electrical connector 10 into a mating electrical connector 110 includes inserting a latching area of a latch of the connector into a mating latching area of the mating connector. A portion of the mating connector is then engaged with a biasing member of the latch as the latching area is moved proximate the mating latching area to resiliently deform a biasing member of the latch. The biasing member is moved toward an unstressed position, causing a locking surface of the latch to engage a mating locking surface of the mating connector. The cooperation of the biasing member with the mating electrical connector and the locking surface with the mating locking surface prevents the unwanted movement of the electrical connector relative to the mating electrical connector.

The cooperation of the biasing member 50 on the latch 28 with the biasing surface biases the reference surface 46 of the latching projection 42 of the connector 10 against a mating connector reference surface 146 of the mating electrical connector 110, thereby maintaining the reference surface 46 in engagement with the mating reference surface 146 to prevent the unwanted movement of the electrical connector 10 relative to the mating electrical connector 110.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing;

a latch extending from the housing, the latch having a latching end and an oppositely facing biasing end;

the latching end having a reference surface;

the biasing end having a biasing member, the biasing member cooperating with a mating connector to bias the reference surface of the latching projection against a mating connector reference surface of the matins electrical connector;

wherein cooperation of the biasing member with the mating electrical connector maintains the reference surface in engagement with the mating reference surface and prevents the unwanted movement of the electrical connector relative to the mating electrical connector.

2. The electrical, connector as recited in claim 1, wherein the latch has an attachment section which secures the latch to the housing.

3. The electrical connector as recited in claim 1, wherein the biasing end has a resilient arm proximate a first end surface provided at the biasing end of the latch.

4. The electrical connector as recited in claim 3, wherein a longitudinal axis of the resilient arm extends in a direction which is essentially perpendicular to a longitudinal axis of the latch.

5. The electrical connector as recited in claim 3, wherein an elongate opening is provided proximate the resilient arm, the resilient arm is positioned between the elongate opening and the first end surface of the latch.

6. The electrical connector as recited in claim 3, wherein a biasing projection extends from the resilient arm and from the first end surface in a direction away from the latching end.

7. An electrical connector comprising:

a housing;

a resilient latch extending from the housing, the resilient latch having a latching region and a biasing region;

the latching region having a latching projection with a locking surface;

the biasing region having a biasing member with a resilient arm proximate an end surface of the biasing region;

wherein cooperation of the biasing member with a mating electrical connector and the locking surface with the mating electrical connector prevents the unwanted movement of the electrical connector relative to the mating electrical connector.

8. The electrical connector as recited in claim 7, wherein the latch projection is deformable in a direction which is essentially perpendicular to a plane of the resilient latch.

9. The electrical connector as recited in claim 8, wherein the biasing member is deformable in a direction which is in the plane of the resilient latch.

10. The electrical connector as recited in claim 7, wherein a longitudinal axis of the resilient arm extends in a direction which is essentially perpendicular to a longitudinal axis of the resilient latch.

11. The electrical connector as recited in claim 10, wherein an elongate opening is provided proximate the resilient arm, the resilient arm extends between the elongate opening and the end surface of the biasing region.

12. The electrical connector as recited in claim 11, wherein a biasing projection extends from the resilient arm and from the end surface of the biasing region in a direction away from the latching region.

13. A method of inserting an electrical connector into a mating electrical connector, the method comprising:

inserting a latching area of a latch of the connector into a mating latching area of the mating connector;

engaging a port on of the mating connector with a biasing member of the latch as the latching area is moved proximate the mating latching area to resiliently deform a biasing member of the latch;

moving the biasing member toward an Unstressed position, causing a locking surface of the latch to engage a mating locking surface of the mating connector;

wherein the cooperation of the biasing member with the mating electrical connector and the locking surface with the mating locking surface prevents the unwanted movement of the electrical connector relative to the mating electrical connector.

14. The method as recited in claim 13, wherein the biasing member is resiliently deformed in a direction which is in the plane of the latch.

15. The method as recited in claim 13, wherein the biasing member has a resilient arm proximate an end surface of the latch.

16. The electrical connector as recited in claim 13, wherein a longitudinal axis of the resilient arm extends in a direction which is essentially perpendicular to a longitudinal axis of the resilient latch.

17. The method as recited in claim 13, wherein an opening is provided proximate the biasing member, the biasing member extends between the opening and an end surface of the latch.

18. The electrical connector as recited in claim 13, wherein a biasing: projection extends from the biasing member is a direction away from the latching area.

19. The electrical connector as recited in claim 13, wherein the latching area is resiliently deformed in a direction which is essentially perpendicular to a plane of the latch.

* * * * *